US005405186A

United States Patent [19]

Hanson et al.

[11] Patent Number: 5,405,186

[45] Date of Patent: Apr. 11, 1995

[54] HEATED SEAT DEVICE

[76] Inventors: Daniel R. Hanson, W5856 - 760th Ave., Beldenville, Wis. 54033; Brian Sylla, 628 1/2 Glen Park Rd., River Falls, Wis. 54022; Gordon Knutson, N7188 County Trunk J., Beldenville, Wis. 54003

[21] Appl. No.: 44,811

[22] Filed: Apr. 8, 1993

[51] Int. Cl.[6] ..... A47C 7/74

[52] U.S. Cl. ..... 297/180.1; 126/208; 297/217.1

[58] Field of Search ..... 297/180.1, 180.12, 180.13, 297/180.14, 217, 461; 126/258, 259, 208

[56] References Cited

U.S. PATENT DOCUMENTS

| | | | |
|---|---|---|---|
| 51,534 | 12/1865 | Andrews | 126/208 |
| 54,808 | 5/1866 | Wright . | |
| 196,890 | 11/1877 | Gordon | 297/180.1 X |
| 208,251 | 9/1878 | Mains . | |
| 1,007,461 | 10/1911 | Lehmann | 126/258 |
| 1,486,756 | 3/1924 | Jaske | 126/258 |
| 2,517,254 | 8/1950 | Steele . | |
| 2,829,635 | 4/1958 | Teller . | |
| 2,845,924 | 2/1956 | Benda . | |
| 2,867,206 | 1/1959 | Mender | 126/4 X |
| 2,904,031 | 9/1959 | Scott . | |
| 3,024,782 | 1/1958 | Knopps . | |
| 3,513,822 | 5/1970 | Korngold | 126/4 |
| 3,744,842 | 7/1973 | Ronning | 297/180.12 |
| 4,372,198 | 2/1983 | Stover, Jr. et al. | 206/258 X |
| 4,475,532 | 10/1984 | Woods . | |
| 4,495,935 | 1/1985 | Lanier . | |
| 4,676,223 | 6/1987 | Peterson . | |
| 4,860,726 | 8/1989 | Barker . | |
| 4,913,126 | 4/1990 | McCall . | |
| 5,121,739 | 6/1992 | Barker . | |

FOREIGN PATENT DOCUMENTS

| | | | |
|---|---|---|---|
| 91101 | 3/1897 | Germany | 126/258 |

OTHER PUBLICATIONS

"Inventing is in his blood", Fargo (North Dakota) Forum, late fall 1993.

Brochure for "Wal-Kin Buck Castle" products, received Feb., 1994.

*Primary Examiner*—Peter R. Brown

*Attorney, Agent, or Firm*—Fredrikson & Byron

[57] ABSTRACT

A portable heated seat device useful for cold weather outdoor seating in remote areas. The device involves the use of a seat support positioned above a central heated air passageway such that heated air rises through the passageway, around the seat support, and under the coat or poncho of the user.

18 Claims, 2 Drawing Sheets

56
54
10
50

HEATED SEAT DEVICE

TECHNICAL FIELD

The present invention relates to a portable, heated seat device that is useful for keeping a person warm outdoors during cold weather, for instance, while ice fishing or hunting.

BACKGROUND OF THE INVENTION

A number of patents have described devices such as seats and the like that can be used outdoors and heated so as to provide warmth to a user. See, for instance, U.S. Pat. Nos. 5,121,739 (Barker), 4,913,126 (McCall), 4,860,726 (Barker), 4,676,223 (Peterson), 4,495,935 (Lanier), 4,475,532 (Woods), 3,024,782 (Knopps), 2,904,031 (Scott), 2,845,924 (Benda), 2,829,635 (Teller), 2,517,254 (Steele), 208,251 (Mains), and 54,808 (Wright).

Certain of these devices are intended to serve two or more purposes, for instance, by providing both cooking and seating surfaces, or for heating both tents and individual users. As a result, many of them are not particularly well-suited to the singular purpose of effectively warming a person sitting on the such a device. It likewise appears that very few, if any, of such devices are widely commercially available.

One example of a commercially available seat is a device called a "Heat Seat", that involves the use of jelled heat fuel held within a vent-type insert that is itself held by the cover of a carrying pail.

A number of disadvantages are associated with devices such as those described above. Many of the devices, for instance, involve the transfer of heat to the sitting surface itself, thereby warming the person, at least in part, by providing for direct contact between the user's body and a heated surface. In many of these, and other, devices, the user's own body may also serve to block or obstruct the flow of heated air.

Direct contact between the body and a heated surface requires that the seating surface be sufficiently covered, as by intermediate layers, or that its temperature be kept sufficiently low, so as to avoid discomfort, or even burning of the user. Devices and seating positions that use the body to block the flow of warm air can raise similar concerns.

Many other devices can be cumbersome to carry, or to assemble and/or use, particularly in situations where the user must also carry assorted other gear and where the user may be wearing cumbersome clothing.

What is clearly desired is a simple, portable, and effective heated seat device that overcomes the problems such as those described above.

DISCLOSURE OF THE INVENTION

The present invention provides a heated seat device that overcomes the problems typically associated with devices described in the art, and that provides an optimal combination of such properties as comfort, warmth, lightweight, convenience, safety, and economy of use. The seat of the present invention provides a seating surface that is positioned above a heat source and heated air passageway in such a manner as to allow substantially all of the heated air to be transferred directly up and under the coat or poncho of the user.

In so doing, the heated seat device of the invention allows a comfortable and controllable amount of heat to be transferred directly under the user's coat and to the body, using a minimal output of heat. As a result, it is possible to avoid direct contact between the body and a directly heated surface, as well as to avoid using the body itself to block or redirect heat. Moreover, the device of the present invention avoids the need for the use of cumbersome fans or blowers, or vents or ducts to redirect heated air, as have been previously described in the art.

According to the present invention there is provided a portable heated seat device comprising a) a base container having a closed bottom end defining an upper surface and a lower surface, and a substantially open top end defining an upper periphery, b) heating means secured within the base container, c) cover means adapted to sealingly engage the upper periphery of the base container, the cover means comprising one or more central apertures of sufficient dimensions to provide a passageway for heated air, d) a seat support retained above the cover aperture, and defining a lower surface directed towards the cover aperture and an upper seating surface, the seat support being positioned to substantially block and redirect the flow of heated air around the seat support after passing through the cover aperture, and e) rigid support means for retaining the seating surface above the cover aperture in such a manner that heated air is able to pass through the central aperture of the cover means, up and around the seat support.

In addition to the features described above, the seat can include optional parts and features, such as carrying means (e.g., straps or handles), and receptacle means for holding related hunting or fishing paraphernalia either inside or on the outer surface of the container.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
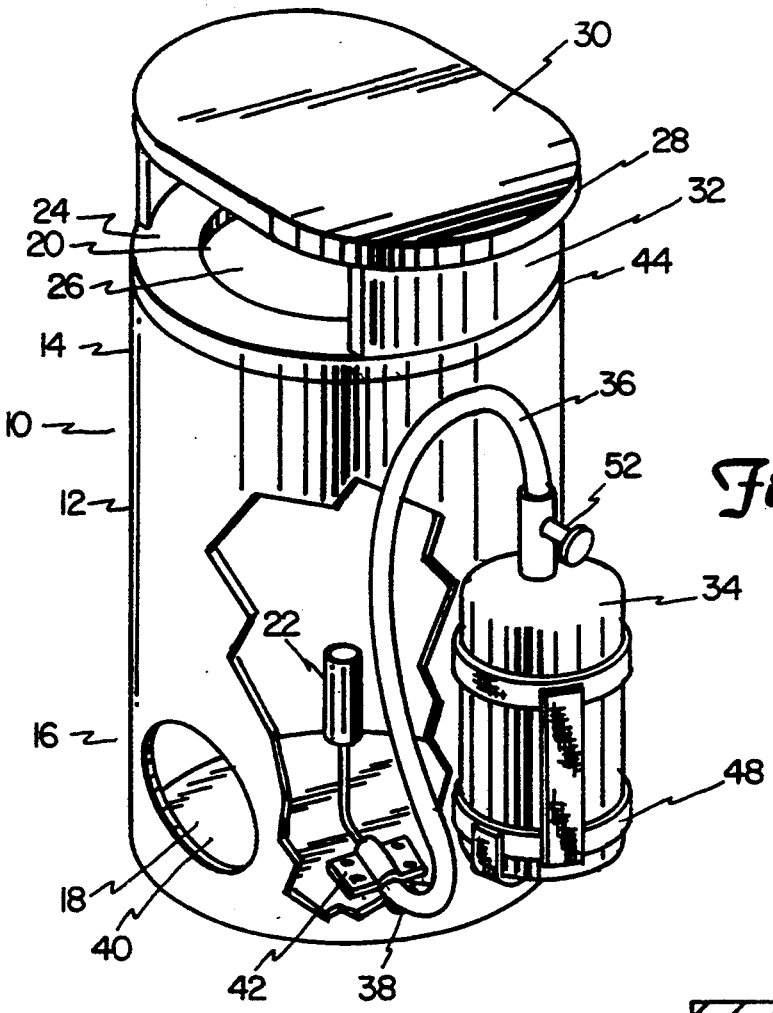
FIG. 1 is a perspective view of a preferred embodiment of a heated seat device according to the present invention, with a cutaway container showing the internal components.

Referring now to FIG. 1 of the drawing, there is shown a preferred heated seat device according to the present invention generally designated by the reference number 10.

Generally, the heated seat 10 comprises a hollow, substantially cylindrical base container 12 of a portable size having upper 14 and lower 16 wall regions, a closed bottom end 18 having an upper surface and a lower surface, and a substantially open top end 20 defining a periphery 44.

The base preferably provides a plurality of access holes 40 of sufficient dimension and proximity to the heating means to allow the user to reach the burner unit 22 in the course of lighting the burner. Such access holes can serve other, or alternative purposes, as well, as described in further detail below.

The heating means of the present invention can be designed to accommodate any suitable fuel source, for instance, canisters of solid or semi-solid fuel, propane cylinders, kerosene, or the like. In a preferred embodiment, the heating means is designed to accommodate a fuel cylinder 34, which is replaceably retained on the outer surface of the lower wall region 16 of base 12 by cylinder holder 48. Cylinder holder 48, in turn, is secured to the desired position on the exterior wall of base 12.

The cylinder is preferably retained in a position that will not interfere with the user's feet while sitting, e.g., it is positioned to the side or rear of the seat, although in a manner that adjustment valve 52 can be easily reached while sitting. The cylinder is releasably connected to fuel supply tubing 36. Fuel supply tubing 36, in turn, passes through the lower wall portion of base 12 through fuel supply hole 38 (partially seen), into the interior of base 12, where it is connected on its opposite end to burner unit 22.

Any suitable materials can be used to provide fuel supply tubing 36, for instance, flexible and/or rigid tubing having either permanent or releasable (e.g., screw in) fittings.

Burner unit 22 is secured within tile base container, preferably centrally, and preferably upon the upper surface of the closed bottom end 18. Burner unit 22 can be secured by any suitable means, e.g., by use of a burner support cuff 42 that is itself secured (e.g., welded, screwed, or otherwise adhered) to tile base of the container. In the preferred embodiment shown if FIG. 1, the burner unit is designed to burn propane, or any similar fuel.

The burner unit 22 is preferably positioned and supported within the base 12 in such a manner that flames will bum within the container, thereby heating air that will rise up to and through aperture 26 and around seat support 28, and under the coat of the user.

Access holes 40 provide the user with ready access for lighting the burner unit. Such access holes can also serve a number of additional, or alternative, purposes, including to provide burner unit 22 with an ample supply of air; to provide a vent that allows unburned gases or fuels to escape from the cylinder; and to provide view holes for the visual inspection of the burner unit 22. The access holes are preferably positioned below the level of the flame of burner unit 22, in order to avoid the loss of heated air through the access holes themselves.

Alternatively, the burner can be remotely lit, for instance by the use of an external means for providing a spark to the burner. In this case, access holes 40 can simply be dimensioned and used for the alternative purposes described above, for instance, for the purpose of providing sufficient oxygen to the burner in the course of its operation.

Heated seat device 10 further comprises cover means 24 adapted to sealingly engage the periphery 44 of the open end of the base container. In this preferred embodiment cover means 24 comprises a single central aperture 26 of sufficient dimension to provide a passageway for heated air that rises from burner 22. In the course of large scale manufacture of such devices, e.g., involving the molding of plastics to form the device, it is entirely possible that cover means 24 could be provided as an integral part of the container itself. The cover means in such case would be considered to be the region of the device that is substantially parallel to the base of the container, and that forms the central aperture.

In such case, access to the interior of the device, for the purpose of either the manufacture and/or use of the device, could be accomplished in any number of other ways, for instance, by means of a removable bottom end; by means of a cylinder having separable upper and lower regions; or by means of a closeable access door on the side of the cylinder.

Heated seat 10 further comprises seat support 28, which is spatially distinct frown the cover means 24 and preferably is larger than and eccentrically positioned with respect to aperture 26 of the cover. Seating support 28 defines an upper surface 30 upon which a person may be seated, and a lower surface 46. The upper seating surface 30 is optionally cushioned to provide further comfort to the user. The seat support 28 can optionally also be provided with a seat back, attached to the rear of the support and rising upwardly to support the back of the user.

Seat support 28 can be provided in any suitable shape, and positioned over the aperture 26 in any suitable position, in order to achieve a desired relationship between sitting comfort and air flow. The surface area of lower surface 46 of seat support 28 is preferably larger than, and overlapping, the surface area of aperture 26, so as to both block the flow of heated air rising through the aperture, and to provide a sufficient space on lower surface 46 for the attachment of rigid support means to seat support 28.

The seat support can be generally circular or oblong, oval, cam-shaped, pear-shaped, or the like. With an oval seat support, for instance, tile seat support can be positioned such that both its longer and shorter central axes overlap central axes of the aperture. Preferably the seat support is provided as an oval or kidney-shaped support, that is eccentrically positioned, e.g., with its longer central axis slightly off center with respect to a parallel central axis of tile aperture. In tile event tile seat support is eccentrically positioned, that portion of the periphery of base cylinder 12 that is nearer to the seat support will be used herein to designate the front of the device. This arrangement provides a comfortable seating surface and allows the user to sit slightly off-center with respect to the axis of the container itself, thereby providing added comfort. Additionally, and importantly, such an arrangement facilitates the warming of the user by creating an air space between the user's back and a coat or poncho, as the coat or poncho lays draped over the cylinder and pulled away slightly from the user's back.

The lower surface 46 of the seat portion is attached to a plurality of rigid support means 32, that serve to secure the seating surface above and apart from the cover means in such a manner that heated air is able to pass through the central aperture of the cover means, up and around the seat support, and to tile body of a sitting person. Although generally rigid when in use, such support means are optionally removable or retractable, or both, in order to remove or lower the seat support during transport or storage. Preferably, the rigid support means comprises a plurality of arcuate rigid support members, for instance, supporting an oval-shaped seat support at its ends.

Rigid support means 32 are preferably configured so as to provide a desired relationship between the volume of warm air able to leave the front (i.e., between the user's legs), as opposed to the rear or sides, of the heated seat device. Moreover, the support means are also preferably configured so as to substantially block the flow of air directly to the legs (i.e., sides) of the seated user. Adjustment of the size (e.g., height and arcuate length) of the support members, and adjustment of the spatial relationship of the support members around the cover aperture itself, either in the manufacture of the seat or by the user, will allow warm air to be directed in a desired and optimal manner.

In a preferred embodiment, for instance, it has been found that support members that are structured to form a forward air passageway (54 in FIG. 3) that is between about one-fourth and about one-half, and preferably on the order of one-third of the arcuate length of the rear air passageway (56 in FIG. 3), provide an optimal, balanced, warming effect to both the rear and front of the user. Using a standard cylindrical device having an outer diameter of about 11¾ inches, such dimensions would correlate with an open forward air passageway of between about 2 and about 7 inches (measured in arcuate length around the open rim of the base periphery), and preferably between about 3 and about 5 inches, as compared to an open rear air passageway of between about 10 and about 20 inches, and preferably between about 12 and about 16 inches.

In such a preferred embodiment the support members are substantially solid. As a result, once the warmed air passes out of the aperture of the device, it passes through the front and rear passageways in approximately the same relative proportions as the openings formed by the support members, yet the warmed air does not pass out the sides of the seat, where it would tend to provide too much warmth to the sides or legs of the seated user.

In a particularly preferred embodiment, a potable heat seat device is provided having a seat support that is generally oval in shape, having a major axis (i.e., "length") and a shorter minor axis ("width"), whereby the seat support is supposed above the aperture with its major axis parallel to, but not overlapping, a central axis of a circular central aperture, and its minor axis parallel to and substantially overlapping a central axis of a circular central aperture. Preferably, the rigid support means of the device comprises a plurality of arcuate, solid, rigid support members, supposing the seat support at its ends, i.e., the sides of the device.

Figure 2:
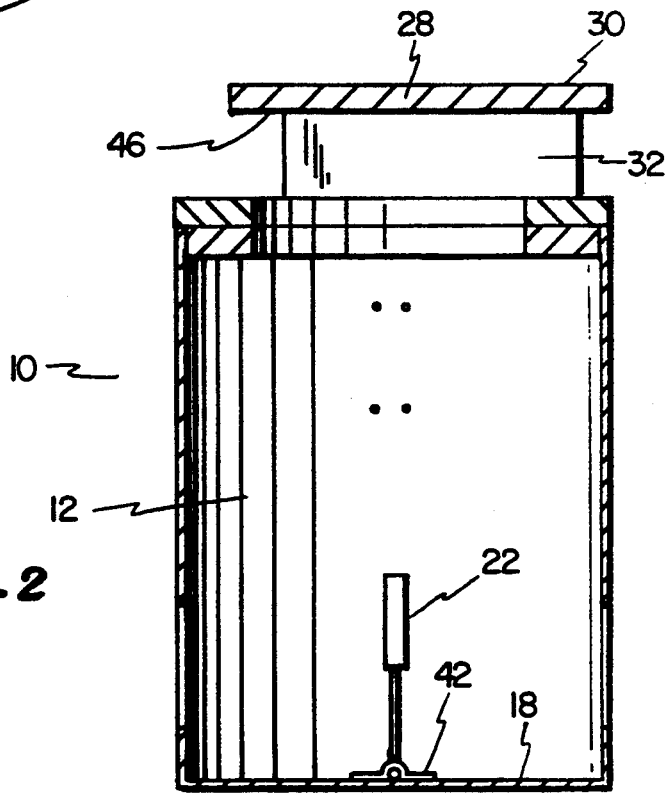
FIG. 2 is a cross-sectional side view of the heated seat device of FIG. 1.

Referring now to FIG. 2, it can been seen that in a preferred embodiment the rigid support means 32 are positioned in such a manner as to support an oval seat support in an off-centered manner, toward the front of the heated seat device. This type of structure provides both comfort to the user, in terms of the position and shape of the seat itself, as well as in terms of the ability of the support members to block heat from reaching the underside of the legs of the user.

Figure 3:
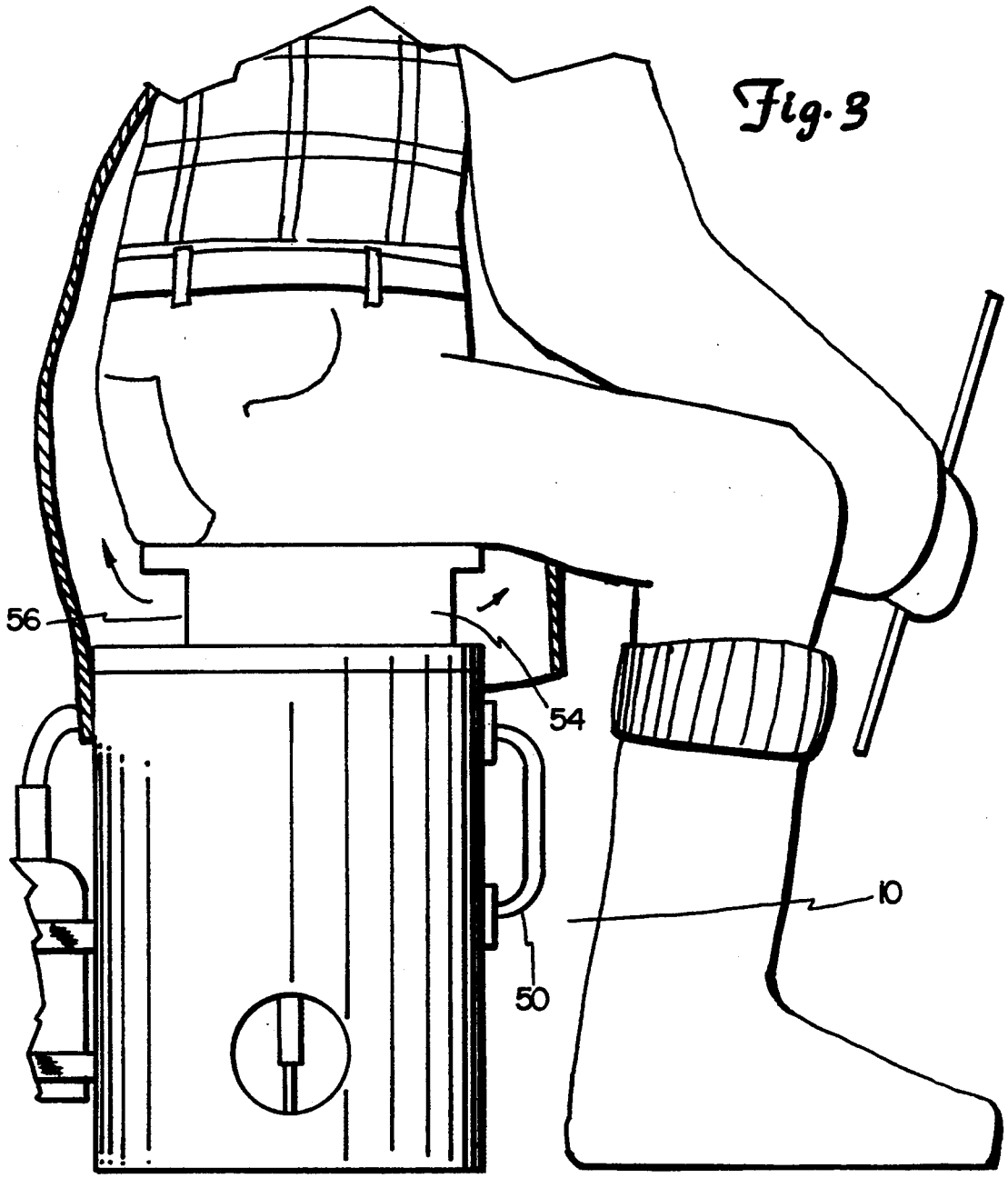
FIG. 3 is a side elevation view of the heated seat device of FIG. 1 in actual use.

FIG. 3 depicts a heated seat device of the present invention in actual use. The heated seat device can be carried to the point of use, for instance by grasping handle 50, and quickly set up. Many of the components described above can be storm in the container itself during transport, for instance, the fuel cylinder and associated burner tubing can be carried in the container and readily reinstalled for use.

Heated seat devices of the present invention can be made using any suitable material, e.g., wood, plastic, or metal, or any combination thereof. Those skilled in the art will recognize the manner in which such materials can be chosen in order to provide an optimal combination of such properties as strength, heat resistance, and weight. A simple embodiment of the invention can be made substantially entirely of plastic and wood, for instance, by cutting a piece of ¾" plywood in sufficient dimensions to serve as a cover for a standard plastic pail, and another piece of such plywood to serve as the seat support. The seat support can similarly be secured in position by cutting solid wooden pieces in the desired arcuate lengths, and gluing or otherwise securing such pieces to both the lower surface of the seat support and the top of the cover. Similarly, a standard propane cylinder can be attached to the exterior wall of the base, e.g., by the attachment of a receptacle, and the cylinder connected via appropriate tubing to a burner, which is itself secured within the cylinder. In a preferred embodiment, devices of the present invention are manufactured on a large scale, for instance, by the molding of plastic materials to integrally form any or all of the base cylinder, cover, rigid support means, and seat support.

In use, the user is expected to find a relatively flat ground surface, sufficiently free of obstructions, in order to stably position the heated seat device. To start the burner, the cylinder valve is opened and a pilot flame or spark is positioned sufficiently near the burner jets to ignite the fuel as it reaches the burner. The height of the burner flames can be visually inspected, either through the access holes 40 or through the open aperture 26 of the cover of the container, in order to allow the user to provide the desired level of heat.

The user sits on seating surface 30 of seat support 28 in a such a manner as to drape his or her coat or jacket, or preferably a poncho, over the extèrior upper wall portion of the container. In so doing, substantially all of the heated air is directed through an air passageway that exists through aperture 26 of the cover, around seat support 28, and into and under the coat of the user. The heat is readily adjustable by the user, for instance, by reaching down to adjust the fuel cylinder valve itself.

The present invention has now been described with reference to preferred embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

What is claimed is:

1. A portable heated seat device means for supporting an occupant comprising:

a) a base container having a closed bottom end defining an upper surface and a lower surface, and a substantially open top end defining an upper periphery, b) heating means secured within the base container, c) cover means adapted to sealingly engage the upper periphery of the base container, the cover means comprising one or more central apertures of sufficient dimensions to provide a passageway for heated air, d) a seat support retained above a cover aperture, and defining a lower surface directed towards the cover aperture and an upper seating surface, the seat support being positioned to substantially block and redirect the flow of heated air around the seat support after passing through the cover aperture, and e) rigid support means for retaining the seating surface above the cover aperture in such a manner that heated air is able to pass through the aperture, up and around the seat support, wherein the seat support is generally oval in shape and positioned eccentrically with respect to the upper periphery of the base container.

2. A portable heated seat device according to claim 1 comprising a single, generally circular central aperture, and a seat support that is larger than the central aperture.

3. A portable heated seat device according to claim 1 wherein the rigid support means comprises a plurality of arcuate rigid support members supporting the seat support.

4. A portable heated seat device according to claim 3 wherein the support members form forward and rear air passageways.

5. A portable heated seat device according to claim 4 wherein the forward air passageway has an arcuate length on the order of one-third of the arcuate length of the rear air passageway.

6. A portable heated seat device according to claim 5 wherein the base container comprises a plurality of access holes, and the heating means comprises a propane cylinder that is replaceably retained on the outer surface of the lower wall region of the base and a burner unit secured centrally within the base container.

7. A portable heated seat device according to claim 1 wherein the base container comprises a plurality of access holes.

8. A portable heated seat device according to claim 1 wherein the heating means is selected from the group consisting of canisters of solid or semi-solid fuel and cylinders of propane or kerosene.

9. A portable heated seat device according to claim 8 wherein the heating means comprises a propane cylinder that is replaceably retained on the outer surface of the lower wall region of the base.

10. A portable heated seat device according to claim 1 wherein the heating means comprises a burner unit secured centrally within the base container.

11. A portable heated seat device means for supporting an occupant comprising:

a) a base container having a closed bottom end defining an upper surface and a lower surface, and a substantially open top end defining an upper periphery, b) heating means secured within the base container, c) cover means adapted to sealingly engage the upper periphery of the base container, the cover means comprising one or more central apertures of sufficient dimensions to provide a passageway for heated air, d) a seat support retained above a cover aperture, and defining a lower surface directed towards the cover aperture and an upper seating surface, the seat support being positioned to substantially block and redirect the flow of heated air around the seat support after passing through the cover aperture, and e) rigid support means for retaining the seating surface above the cover aperture in such a manner that heated air is able to pass through the aperture, up and around the seat support, wherein the rigid support means comprise a plurality of arcuate rigid support members supporting the seat support and forming forward and rear air passageways.

12. A portable heated seat device according to claim 11 wherein the seat support is generally oval.

13. A portable heated seat device according to claim 11 wherein the base container comprises a plurality of access holes.

14. A portable heated seat device according to claim 11 wherein the heating means is selected from the group consisting of canisters of solid or semi-solid fuel and cylinders of propane or kerosene.

15. A portable heated seat device according to claim 14 wherein the heating means comprises a propane cylinder that is replaceably retained on the outer surface of the lower wall region of the base.

16. A portable heated seat device according to claim 11 wherein the heating means comprises a burner unit secured centrally within the base container.

17. A portable heated seat device according to claim 11 wherein the forward air passageway has an arcuate length on the order of one-third of the arcuate length of the rear air passageway.

18. A portable heated seat device according to claim 17 wherein the base container comprises a plurality of access holes, and the heating means comprises a propane cylinder that is replaceably retained on the outer surface of the lower wall region of the base and a burner unit secured centrally within the base container.

* * * * *